US006082167A

United States Patent [19]

Lovas

[11] Patent Number: 6,082,167

[45] Date of Patent: Jul. 4, 2000

[54] TOOL FOR CRIMPING A TEE OR MAIN

[76] Inventor: Gary Lovas, 3431 Woodland Dr., Murrysville, Pa. 15668

[21] Appl. No.: 08/982,553

[22] Filed: Dec. 2, 1997

Related U.S. Application Data

[60] Continuation-in-part of application No. 08/893,488, Jul. 11, 1997, Pat. No. 5,794,485, which is a division of application No. 08/574,723, Dec. 19, 1995, Pat. No. 5,694,735.

[51] Int. Cl.[7] ..... B21D 7/06; B21D 19/00

[52] U.S. Cl. ..... 72/409.18; 72/409.13; 72/461

[58] Field of Search ..... 72/409.01, 409.13, 72/461, 409.18; 81/426.5, 419, 418

[56] References Cited

U.S. PATENT DOCUMENTS

| | | | |
|---|---|---|---|
| 31,528 | 3/1984 | Mieyal | 52/506.07 |
| 2,166,347 | 7/1939 | Farney | 72/461 |
| 3,181,340 | 5/1965 | Gruetzmacher | 72/409.01 |
| 3,289,455 | 12/1966 | Pisko | 72/409.01 |
| 3,461,713 | 8/1969 | Donath | 72/409.01 |
| 3,977,144 | 8/1976 | Jahn | 52/745.13 |
| 4,637,242 | 1/1987 | Undin | 72/461 |
| 5,042,286 | 8/1991 | Wiebe et al. | 72/461 |
| 5,065,608 | 11/1991 | Skelton | 72/409.01 |

FOREIGN PATENT DOCUMENTS

| | | | |
|---|---|---|---|
| 175717 | 10/1906 | Germany | 72/409.01 |
| 580994 | 10/1976 | Switzerland | 72/461 |

*Primary Examiner*—Daniel C. Crane
*Attorney, Agent, or Firm*—Arnold B. Silverman; Eckert Seamans Cherin & Mellott, LLC

[57] ABSTRACT

The present invention relates to a method of forming a ceiling. The method comprises the steps of setting a tool for a desired length of crimp of a tee or main by adjusting a plate in a slot of the tool. Then the tee or main is cut to a desired length. An end of tee or main is inserted into a slot in the tool to a desired length. Then the crimping tee or main is rotated about 90° with the tool without removing any length from the tee or main. The tool is separated from the tee or main. The present invention also relates to a tool to crimp a tee or main. The tool comprises a housing having an end, with a first slot disposed in the end. Additionally, the tool comprises a plate disposed in the first slot of the housing. The plate is adjustable in regard to position in the first slot so the tee or main can be inserted into the first slot a desired distance defined by where the plate is disposed in the first slot. In another embodiment of the invention, the tool has a pair of relatively rotatable elements each having a handle and a clamping portion so as to facilitate firm interengagement with the tee or main during crimping and ready release thereafter. An adjustable slot is provided in the tool so as to control the depth of crimping.

11 Claims, 7 Drawing Sheets

TOOL FOR CRIMPING A TEE OR MAIN

CROSS REFERENCE TO RELATED APPLICATION

This application is a Continuation-in-Part Application of U.S. patent application Ser. No. 08/893,488, filed Jul. 11, 1997 (now U.S. Pat. No. 5,794,485) which was a division of U.S. patent application Ser. No. 08/574,723, filed Dec. 19, 1995 (now U.S. Pat. No. 5,694,735).

BACKGROUND OF THE INVENTION

1. Field of the Invention

The present invention is directed toward a tool for use in ceiling construction. More specifically, the present invention is related to a tool and a method of its use for crimping a tee or main.

2. Description of Prior Art

In installing prior-art revealed edge ceiling tile with ¼ inch reveal, there has been the problem of needing to install the ceiling tiles, mains, and wall mold at the exact same height. Such installation generally involved measuring the area for the length of tile to be installed, cutting the tile to this desired length, installing the tile, marking or scribing the tile along the edge of the wall mold, removing the tile, and cutting along the scribe so that the finished tile will have a ¼ inch revealed edge along the wall mold and reinstalling the ceiling tile.

SUMMARY OF THE INVENTION

The system of the present invention has solved the above-described problem in installing revealed edge ceiling tile with ¼ inch reveal, for example. The ceiling tees and mains will be installed ¼ inch above the height of the wall mold. The tees and mains which will be resting on the wall mold will be crimped ¼ inch using the tool of the present invention. One then measures the area for the length of tile to be installed, cuts the tile to this desired length, and installs the tile.

Using the tool of the present invention will save much time by eliminating the need to cut the revealed edge in along the wall mold. Also, this tile is usually very brittle and if the cut is not done perfectly, it becomes very noticeable of a poor job. Other trades who need access above the ceiling after the tile is in place usually damage this brittle revealed edge resulting in the need to replace the entire ceiling tile and repeat the steps described above. The tool of the present invention will leave a clean finish along the wall mold and make it very easy for other trades to remove and reinstall the tile without any damage to the tile.

The present invention also relates to a method of forming a ceiling. The method comprises the steps of setting a tool for a desired length of crimp of a tee or main by adjusting a plate in a slot of the tool. Subsequently, one cuts the tee or main to a desired length. Next the portions of the tee or main to be crimped are inserted into the slot in the tool to the desired length of crimp. Subsequently, there is the step of crimping the tee or main about 90° from its original orientation with the tool without removing any length from the tee or main. Next, one separates the tool from the tee or main.

The first embodiment of the product of the present invention relates to a tool to crimp a tee or main. The tool comprises a housing having an end, with a first slot disposed in the end. Additionally, the tool comprises a plate disposed in the first slot of the housing. The plate is adjustable in regard to position in the first slot so the tee or main can be inserted into the first slot a desired distance defined by where the plate is disposed in the first slot.

In another embodiment of the invention a tool and associated method involve having a pair of relatively pivotal elements which have handle portions and tee or main engaging portions with a slot of adjustable depth being provided. As in the other embodiment, the tee or main is inserted into the slot to the desired depth. After that, the handles are firmly engaged so as to clamp the tee or main portion with rotation of the tool serving to effect the desired deformation of the tee or main.

It is an object of the present invention to provide an improved tool and associated method for facilitating rapid efficient assembly of tee and main components employed in the ceiling so as to achieve the desired revealed edge without the burdensome practices of the prior art.

It is another object of the invention to provide such a system wherein an adjustable slot in the tool facilitates rapid control over the extent of bending of the tee or main.

It is yet another object of the present invention to provide such system which may be employed with conventional tees, mains and ceiling tile.

It is yet another object of the present invention to provide such a system which is economical and easy to employ.

These and other objects of the invention will be more fully understood from the following description on reference to the illustrations appended hereto.

DESCRIPTION OF THE PREFERRED EMBODIMENTS

The terms "tee" and "main" as used herein shall have the ordinary meaning employed in connection with ceiling constructions of the type toward which the invention is directed.

Figure 1:
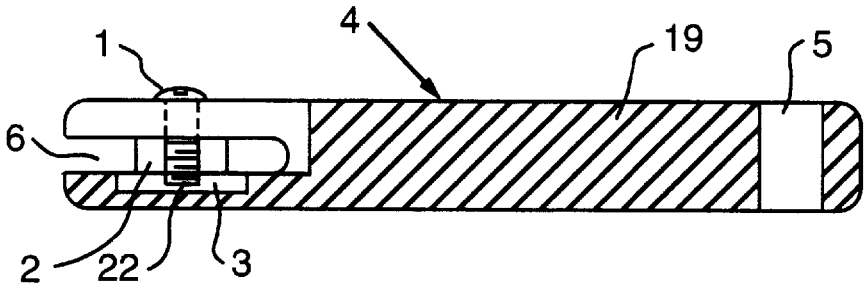
FIG. 1 is side view of a first embodiment of a tool of the present invention.
Figure 2:
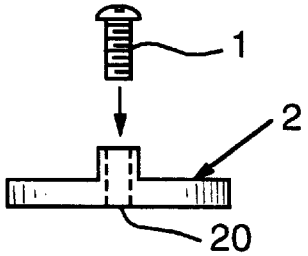
FIG. 2 is an exploded front view of a plate and screw of the present invention.
Figure 3:
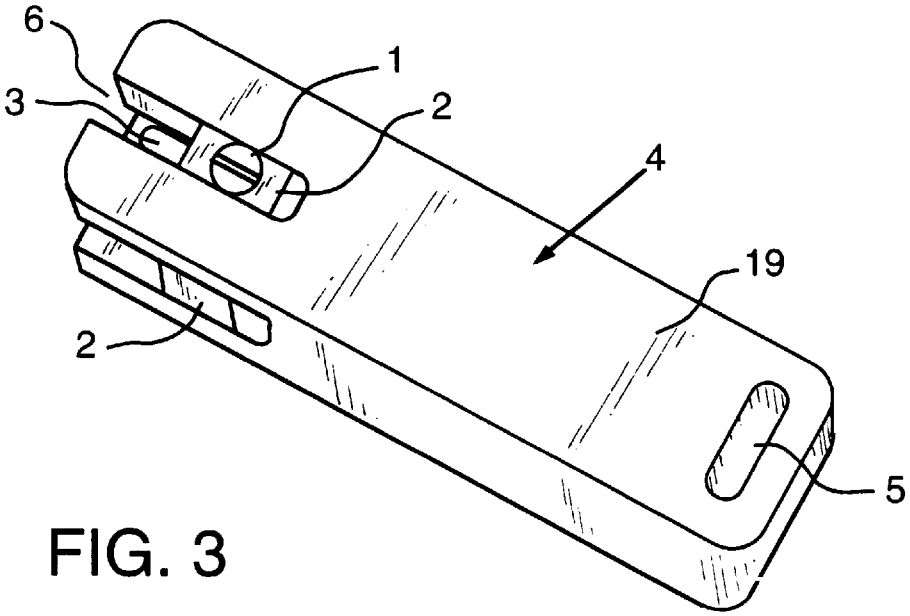
FIG. 3 is a perspective view showing the top, one side and one end of a tool, of the present invention.
Figure 7:
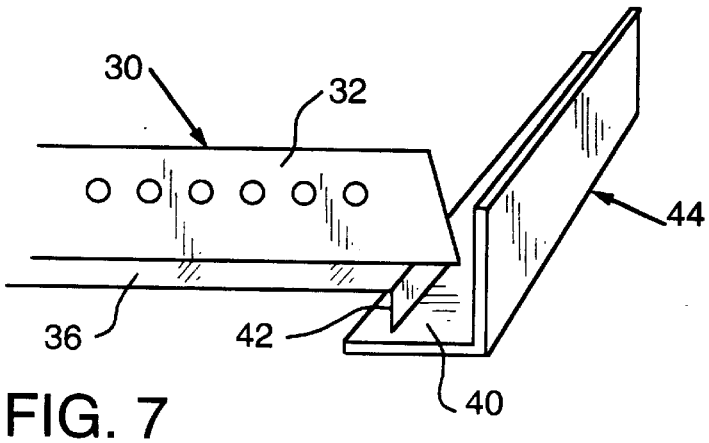
FIG. 7 is a schematic perspective view of the tee on a wall mold.

Referring to the drawings wherein like reference numerals refer to similar or identical parts throughout the several views, and more specifically to FIGS. 1–3 thereof, there is shown a small hand tool 4 to be used by suspended ceiling grid installers when revealed edge ceiling tile is used. Most commonly, the thickness of the revealed edge of the tile ranges between 3/16 of an inch to ½ inch. Tool 4 is adjustable to accommodate this range of dimensions. As shown in FIG. 7, the purpose of this tool 4 is to put a crimp 42 in the end of the tee 30 or main which will raise the tee 30 or main above the wall the height of the thickness of the revealed edge of the ceiling tile to be installed. This crimp 42 will allow the finished surface of the ceiling tile to rest firmly on the wall mold 44 while the edge of the ceiling tile rests firmly on the tees 30 and main. As shown in FIGS. 1–3, a bolt 1 is threadedly received within internally threaded bore 20 of plate 2 with the free end 22 of the bolt extending into elongated slot 3 formed within the body of tool 4. This serves to define a slot 6 within which the end of the tee or main to be crimped may be inserted. An opening 5 is provided through the end of the elongated body 19 for receipt of a key chain, string, belt or other item which facilitates ease of holding the tool or securing the same to a belt or storage hook when not in use.

Figure 4:
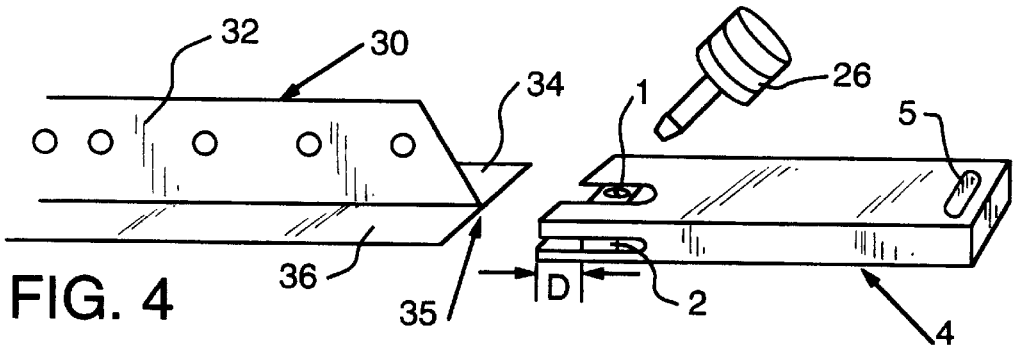
FIG. 4 is a schematic perspective view of the tool of the present invention being applied to a tee and an associated screwdriver.

Referring again to FIGS. 4–7, there is shown the tool 4 and a screwdriver 26 adapted to rotate bolt 1 once the slot is depth determined or to alter the slot depth. As shown in FIG. 4, the aligned tee or main 30 has an upstanding fin 32 and a horizontal portion 35 which has a pair of horizontal webs 34, 36 on opposite sides of fin 32 and which will enter the slot 6 of the tool 4.

Figure 5:
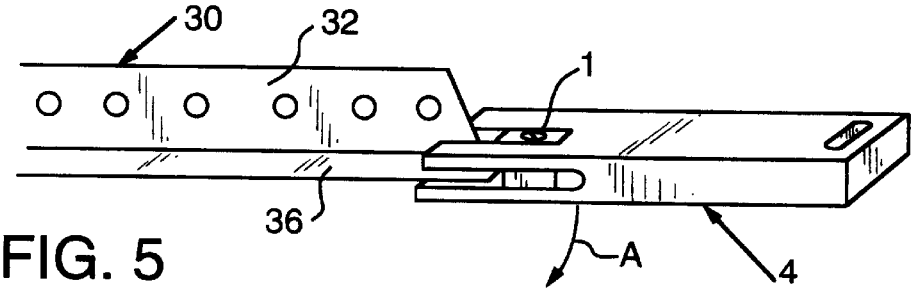
FIG. 5 is a schematic perspective view of the tool with the tee in the first slot.
Figure 6:
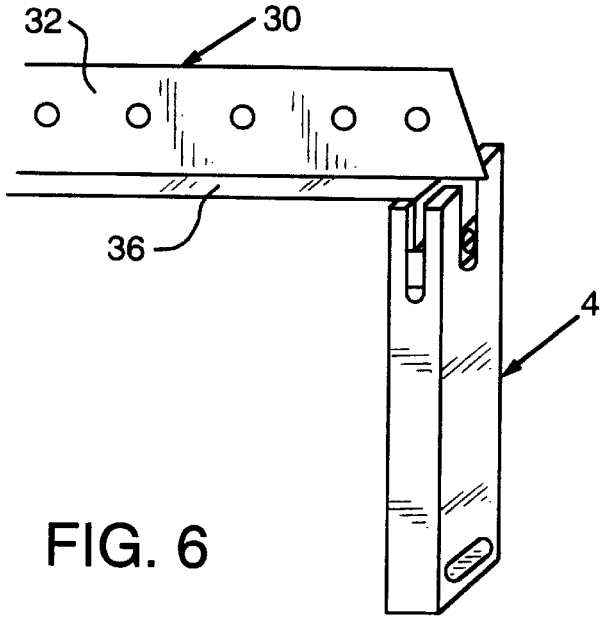
FIG. 6 is a schematic perspective view of the tool after crimping horizontal portions of the tee.

Referring still to FIGS. 4 through 6, it will be appreciated that the plate 2 is set to establish the desired depth of slot D, after which screwdriver 26 is employed to tighten the bolt 1. After that, horizontal webs 34, 36 of the tee 30 are inserted into slot 6 (FIG. 5) and the tool is rotated approximately 90° as indicated by arrow A to assume the position shown in FIG. 6 which means that the end portions of horizontal segments 34, 36 have been bent about 90° with respect to the original position. The tool 4 is then removed from the crimped or bent end and the crimped portion 42 is positioned on the horizontal leg 40 of wall mold 44 to achieve the desired spacing as shown in FIG. 7.

Figure 8:
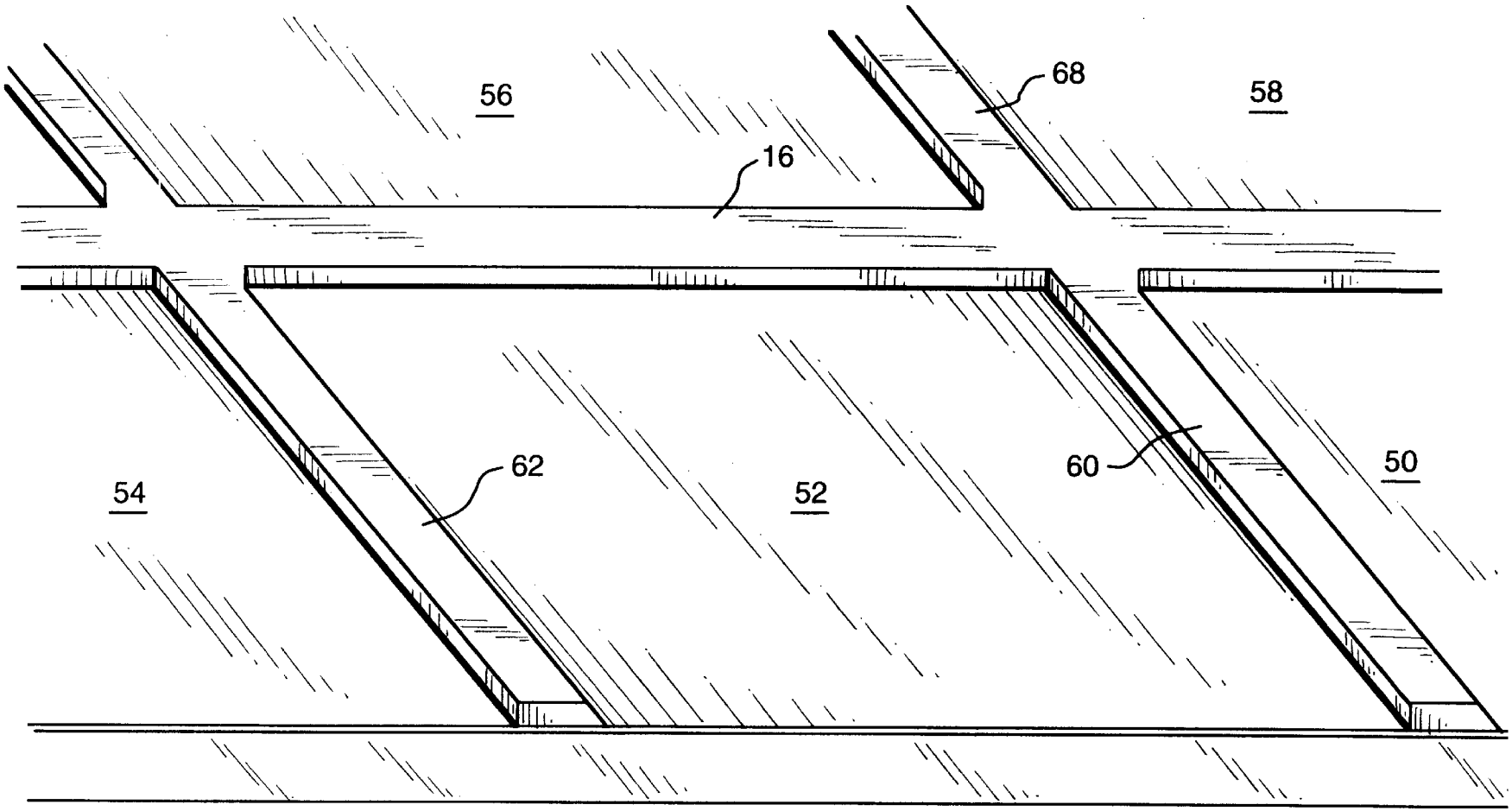
FIG. 8 is a schematic perspective view of a portion of a ceiling with tees and tile showing revealed tile edges.
Figure 9B:
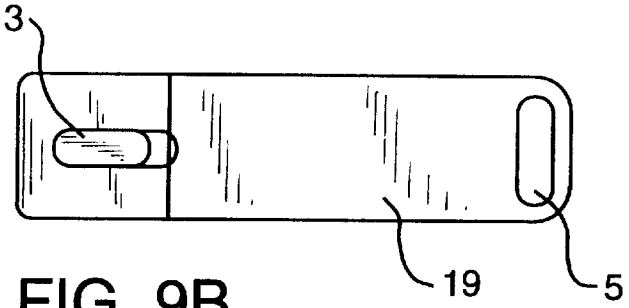
FIG. 9B is a top plan view of a body portion of the tool of the present invention.
Figure 9E:
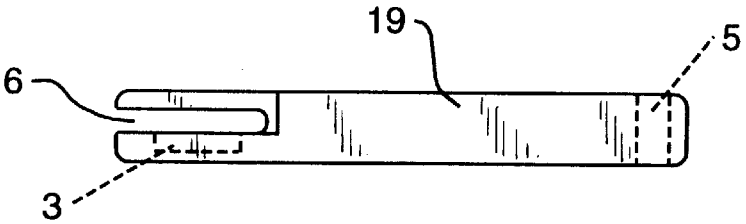
FIG. 9E is a front elevational view of the body portion of the tool.
Figure 9A:
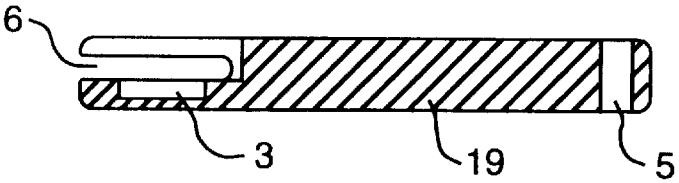
FIG. 9A is longitudinal cross-sectional view of a portion of the body of a tool of the present invention.
Figure 9D:
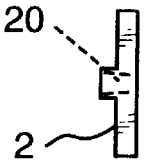
FIG. 9D is a right side elevational view of the plate of FIG. 9C.
Figure 9C:
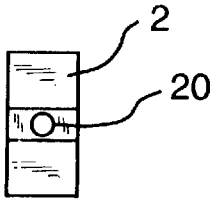
FIG. 9C is a top plan view of a plate which combines with the body portion of the tool to establish the desired slot for entry of a tee or main portion to be crimped.

The result is a ceiling with tiles 50, 52, 54, 56, 58 and tees 16, 60, 62 on wall molds 18, as shown in FIG. 8.

FIGS. 9A–9E show details of a preferred embodiment of the tool of the present invention.

According to FIGS. 10 through 17, another embodiment of the tool will be considered. The tool has a pair of relatively rotatably mounted elements 84, 88 which pivot about the axis of fastener 99. Rotatable element 84 has a handle portion 86, a clamping portion 94 and a transition portion 92. Rotatable element 88 has a handle portion 90, a clamping portion 96 and a transition portion 98. In the form shown in FIG. 10, the tool is in a closed or clamping position. Elements 86, 90, when in a closed position, define a forwardly open, generally horizontal, slot 140 which will engage a tee or main in a manner to be described herein. As best shown in FIGS. 10, 12, 15 and 17, the depth of slot 115, which is generally perpendicular with respect to and communicates with slot 140, is determined by the position of slide member 108.

Figure 14:
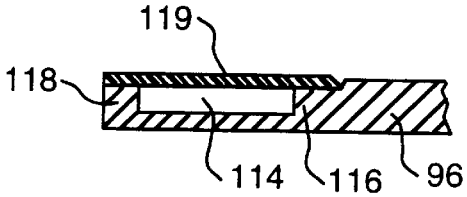
FIG. 14 is a fragmentary cross-sectional illustration showing a portion of a modified lower slot defining tool portion.

Referring to FIGS. 10 through 14, the slide member 108 has an elongated upper portion 110 which is secured to an upper portion of a generally L-shaped element 112 which moves generally horizontally within slot 140 so as to define the depth thereof. In effecting positioning of the slide element 108, screw 100 which has externally threaded shank 104, engaged with a threaded bore 103 of the gripping portion 94, is loosened and the slide member 108 is moved so that the screw 100 is positioned within slot 106 in the desired position to establish the desired depth of grooves 115, 140. The screw is then tightened. Clamping portion 90 of element 84 has an upwardly open recess as shown in FIG. 14 within which the lower portion of 112 moves.

Figure 10:
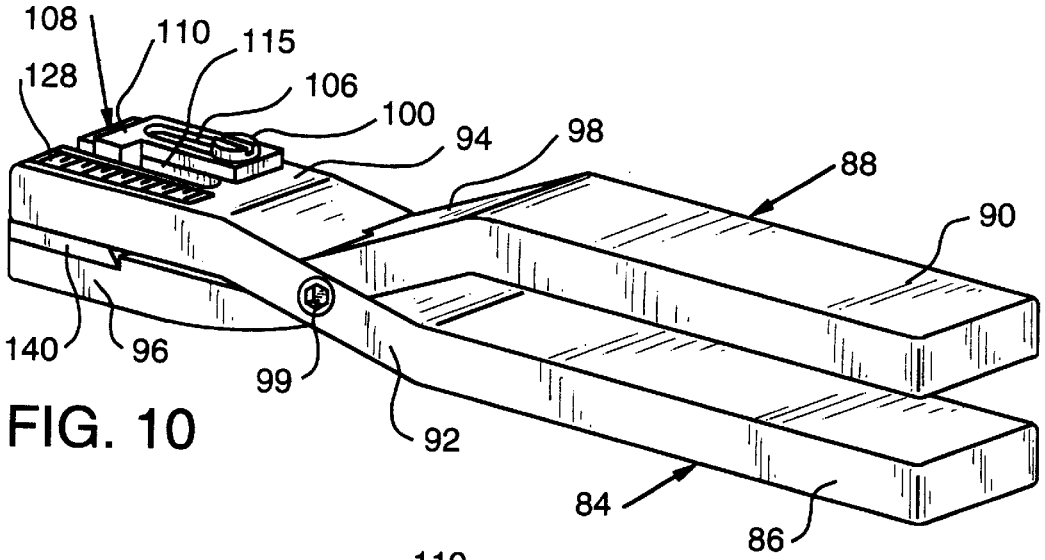
FIG. 10 is a perspective view of another embodiment of the tool of the present invention.
Figure 11:
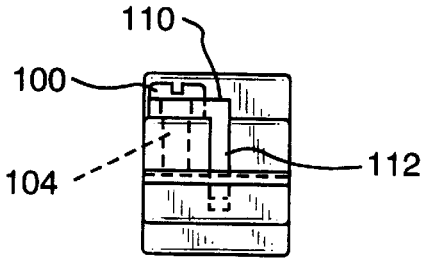
FIG. 11 is a left-hand elevational view showing a portion of the slot arrangement in the tool.
Figure 12:
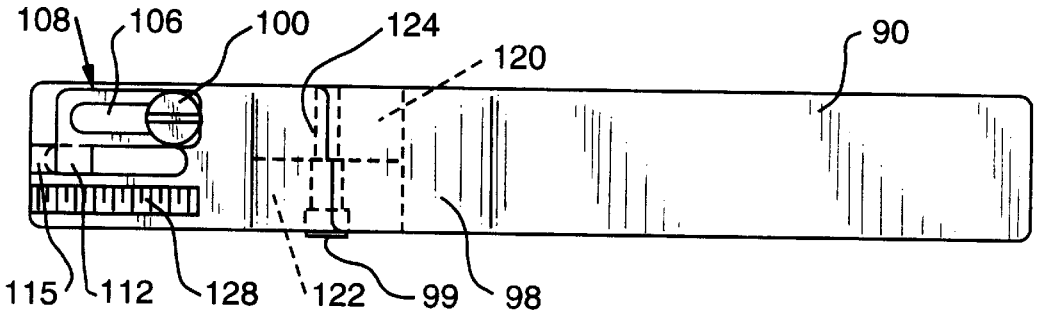
FIG. 12 is a top plan view of the tool of FIG. 10.
Figure 13:
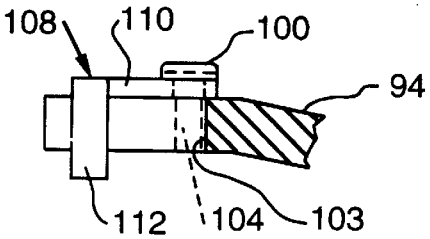
FIG. 13 is a fragmentary elevational view of a portion of the upper slot defining part of the tool.

In FIG. 12 there is shown in phantom a bore-containing portion of transition section 122 of element 88 through which the fastener 99 which may take the form of a screw or rivet, passes with transition section 98 which connects clamping portion 96 with transition portion 90. Similarly, transition portion 98 has a section 122 with a bore through which fastener 99 passes. Fastener 99 has a reduced diameter portion 124. Section 122 is in surface-to-surface engagement with a similar section 120 of element 84 which connects handle portion 86 with clamping portion 94. In this manner, the two elements may be rotatable so as to move from a closed clamping position, such as shown in FIG. 10, to an open position wherein the handle portions 86, 90 are rotated in opposite directions so as to enlarge the distance there between. For convenience of setting the slot to the desired depth, a scale 128 is secured to the upper surface of the tool adjacent to slot 115. Any desired measuring marks and associated legends may be employed.

In the embodiment of FIG. 14, the clamping portion 96 on each side of slot 115 will have transverse supports 116, 118 which support a resinous plastic pad 119 which engages the tees or mains being deformed so as to minimize damage to the exposed surface thereof. The pads 119 must be sufficiently smooth and firm so as not to interfere with the crimping operation.

Figure 15:
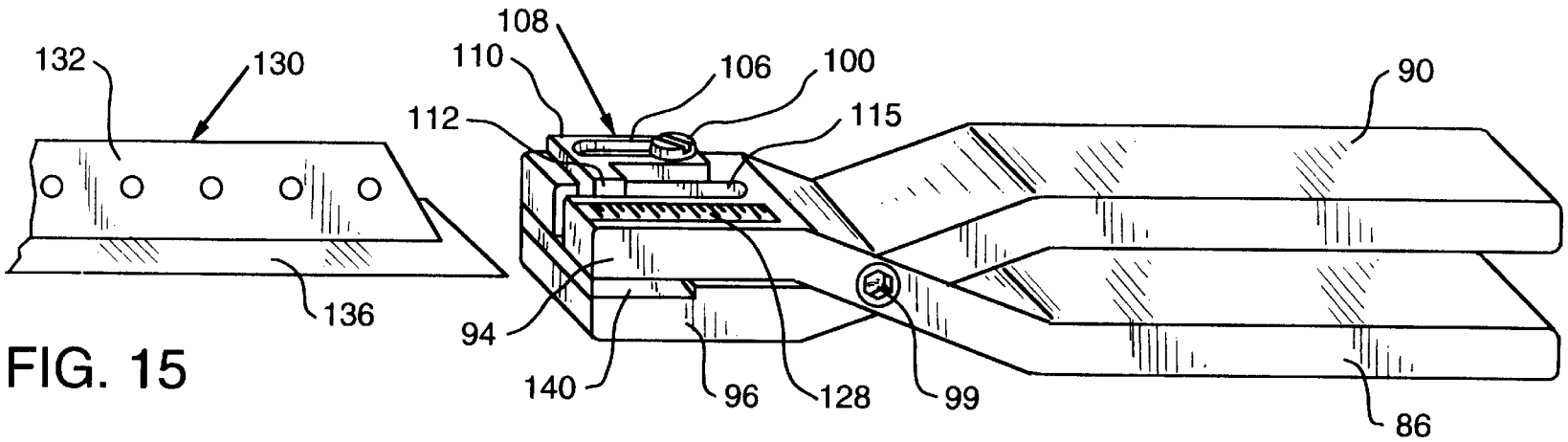
FIG. 15 shows a perspective view of a tee and the tool of FIG. 10 positioned adjacent thereto.
Figure 16:
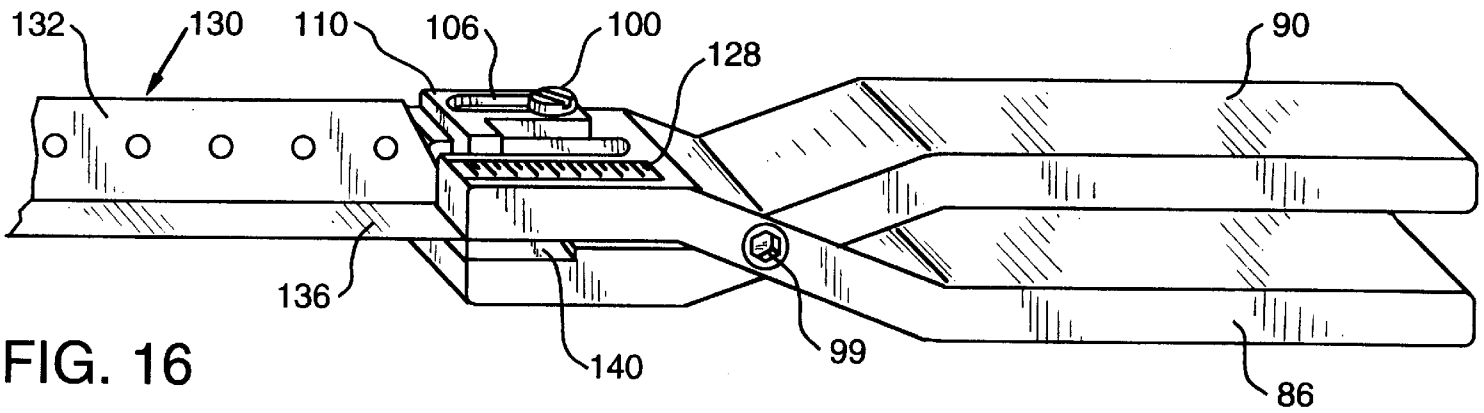
FIG. 16 is similar to FIG. 15, but shows the tool in engagement with a portion of the tee to be deformed.
Figure 17:
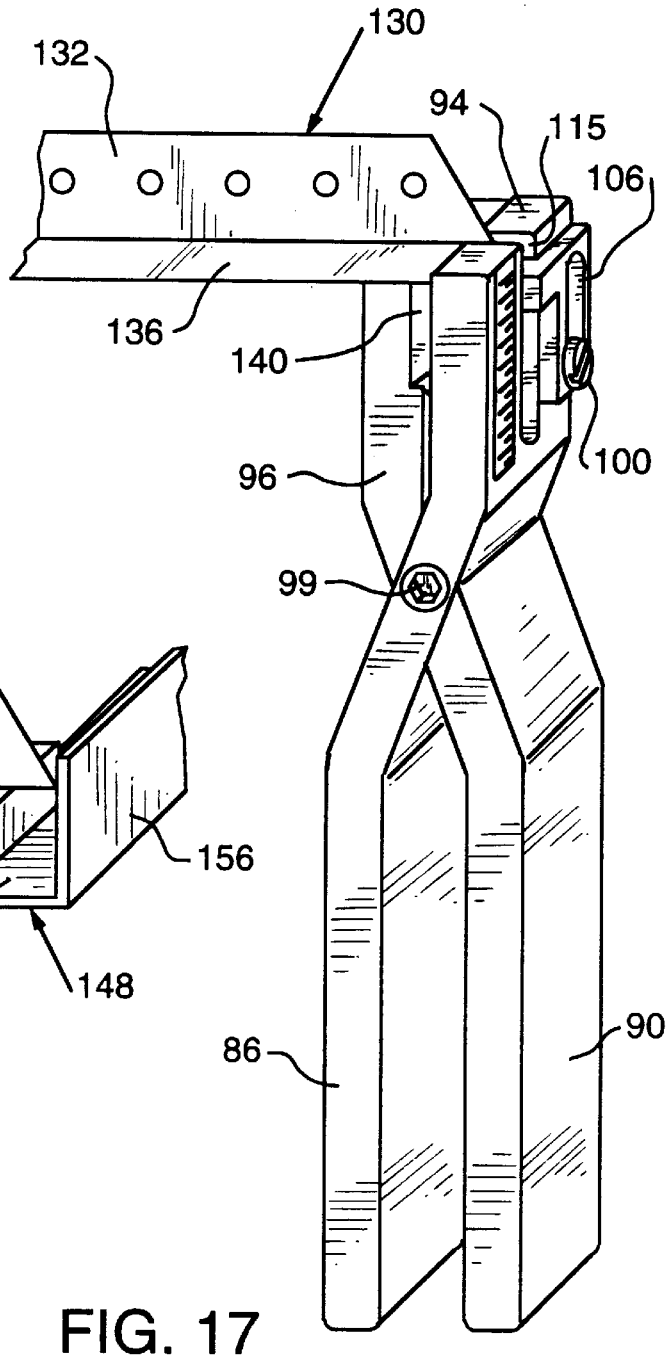
FIG. 17 is similar to FIG. 16, but shows the tool and tee after crimping.

Referring to FIGS. 15 through 17, a sequence of operation of the tool in practicing the method of the invention will be considered. The tool has had slide element 108 moved to the desired position so as to create the predetermined slot depth in slots 115 and 140 thereby limiting the extent of penetration of the tee or main to the desired depth. The user squeezes the handle portions 86, 90 so as to urge them together thereby creating the desired closed position. The tee member 130 is translated so that the free end of the base 136 enters slot 140 and the free end of the fin 132 enters slot 115. When the tee member is fully inserted into the tool as shown in FIG. 16, the user rotates the tool to assume the position shown in FIG. 17 wherein the deformed portion of the base 136 has assumed a position generally perpendicular to the remainder of the base 136 and the tool has been rotated through an angle of approximately 90 degrees.

Figure 18:
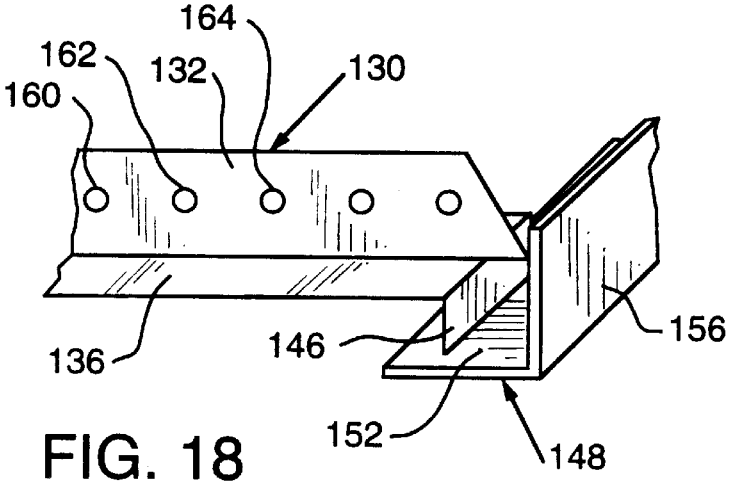
FIG. 18 is a fragmentary perspective view showing a crimped tee member supported on an adjacent wall mounted mold member.

As shown in FIG. 18, the tee member which has the downwardly projecting flange 146 formed by the operation illustrated in FIGS. 15 through 17 has the lower edge of flange 146 resting on element 148 which has an upstanding flange 156 which may be secured to a wall and a generally perpendicular base 152 on which the lower end of flange 146 rests. In this manner, the revealed edge of the ceiling tile will automatically be spaced appropriately without requiring the burdensome and time consuming inefficient prior art practices. Openings such as 160, 162, 164 in fin 132 permit wires to be secured to the tee or main which wires are also attached to overlying decking.

It will be appreciated, therefore, that the present invention has provided an effective means of establishing a ceiling while minimizing the amount of work required in achieving adequate spacing among tees, mains and wall mounted supports. Tees generally have a length of about 2–4 feet and mains about 12 feet. Both have generally the same shape. All of this is accomplished by the use of a tool which has an adjustable depth slot which predetermines the dimension of the flange, such as flange 146, which may be created and thereby determines the spacing with respect to the revealed edge tile. In one embodiment, the tool is a fixed tool which is rotated as a unit. In another illustrated embodiment, the tool has a plier-like type structure, while providing the adjustable tee or main receiving grooves. The method of the invention provides a simple means for effecting the desired deformation of the tees and mains.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A tool for forming a ceiling tee or main comprising first and second elongated clamping members, each having a handle, a clamping portion and a connecting portion, means rotatably securing said first and second clamping members to each other, said tool having a closed position, wherein, said first handle and said second handle are in a first position with a relatively small gap therebetween and an open position when said first handle and said second handle are relatively spaced a greater distance from each other, and said tool having tee or main receiving a first slot provided with adjustable stop means movable within said first slot to define the depth of said first slot.

2. A tool for forming a ceiling tee or main comprising first and second elongated clamping members, each having a handle, a clamping portion and a connecting portion, means rotatably securing said first and second clamping members to each other, said tool having a closed position, wherein, said first handle and said second handle are in a first position with a relatively small gap therebetween and an open position when said first handle and said second handle are relatively spaced a greater distance from each other, said tool having a tee or main receiving first slot provided with adjustable stop means to define the depth of said first slot, said first slot being an elongated slot formed within said first elongated clamping member, and said adjustable stop means having an adjustable stop member slidably movable within said first slot means.

3. The tool of claim 2 including a second slot oriented generally perpendicular with respect to said first slot formed between said first clamping portion and said second clamping portion when said tool is in said closed position.

4. The tool of claim 3 including said adjustable stop member being slidable within said second slot, and locking means for securing said adjustable member at a desired position within said first and second slots, whereby said tee or main will be receivable within said first slot and second slot until it contacts said movable stop member.

5. The tool of claim 4 including said adjustable stop member having an upper portion which defines a slot through which a locking fastener passes and a lower portion which projects into said first and second slots.

6. The tool of claim 5 including said locking fastener being a screw which is threadedly secured to the clamping portion of said first elongated clamping member.

7. The tool of claim 6 including scale means disposed adjacent to said first slot for determining the position of said adjustable stop means.

8. The tool of claim 6 including said first elongated clamping member and said second elongated clamping member being substantially rigid except for said adjustable stop member.

9. The tool of claim 7 including said second elongated clamping portion having a recess facing said first slot.

10. The tool of claim 7 including resinous plastic pad means for contacting a portion of said tee or main to resist damage thereto during said crimping, and said pad means including a pair of pads secured to said second clamping portion on opposite sides of said first slot.

11. The tool of claim 3 including said first slot being generally vertically oriented and said second slot being generally horizontally oriented when said tool is crimping a generally horizontally oriented tee or main.

* * * * *